United States Patent [19]

Chuan

[11] Patent Number: 4,886,185

[45] Date of Patent: Dec. 12, 1989

[54] STRUCTURE OF A CONTAINER AND CLOSURE

[76] Inventor: Chang C. Chuan, No. 32, Ching An Hsing Tswen, Ta PWU Rd., Chian Village, JWEI Fang Town, Taipei County, Taiwan

[21] Appl. No.: 341,158

[22] Filed: Apr. 21, 1989

[51] Int. Cl.[4] ..... B65D 39/00

[52] U.S. Cl. ..... 220/307; 220/326

[58] Field of Search ..... 220/307, 326, 324, 281; 215/280, 287, 289, 296, 355, 279

[56] References Cited

U.S. PATENT DOCUMENTS

| | | | |
|---|---|---|---|
| 676,089 | 6/1901 | Heath | 215/279 |
| 735,439 | 8/1903 | Asdell | 215/296 |
| 907,091 | 12/1908 | Ricke | 215/279 |
| 3,898,046 | 8/1975 | Ikeda et al. | 215/355 |
| 3,900,122 | 8/1975 | Dichter | 215/355 |
| 3,986,635 | 10/1976 | Niskin | 220/326 X |
| 4,682,707 | 1/1987 | Wiles | 220/307 |
| 4,804,099 | 2/1989 | Chuan | 215/279 |

*Primary Examiner*—Donald F. Norton

*Attorney, Agent, or Firm*—Morton J. Rosenberg; David I. Klein

[57] ABSTRACT

A new structure of a container and closure adapted for manufacture by an injection molding process is provided. The container includes an integrally formed neck portion having an annular spring for releasably engaging an engagement step formed in the body portion of the bottle cap. The cap is released by simply pressing a projection which extends from the spring through an opening formed in the bottle neck.

5 Claims, 3 Drawing Sheets

STRUCTURE OF A CONTAINER AND CLOSURE

BACKGROUND OF THE INVENTION

The present invention defines a new structure of a container and closure that can produce a pleasant sound effect when the container is opened to enhance the surrounding atmosphere. The whole structure is formed from plastic material by means of an injection molding process, which is both economical and sanitary.

Conventional "easy open" containers are either made of aluminum or an iron material, having a ring puller attached to a top formed in the container body. The opening process requires prying up the ring puller from the container body with a finger or tool. During the opening operation, an abrupt application of excessive pulling force may separate the ring puller from the container tab, or the resulting shock from the prying up and peeling up of the tab by the ring puller may cause the liquid in the container to splash out. Further, during the operation to open these prior art containers, the user's finger may be injured by the sharp metal edge of the tab to which the ring puller is coupled.

SUMMARY OF THE INVENTION

A plastic container having a reversibly releasable closure formed by a bottle cap and a neck portion of the container is provided. The container includes a body portion and a neck portion extending from one end thereof. The container also includes a protective ring portion extending from one end to a height substantially equal to the closure. The bottle cap is reversibly releasably secured within the neck portion by an annular spring disposed within an internal annular groove formed in the neck. The annular spring includes a projection extending through an opening formed in the container neck for transmitting an applied force to the spring for disengagement with an engagement step portion of the body of the bottle cap.

DESCRIPTION OF THE PREFERRED EMBODIMENTS

Figure 1:
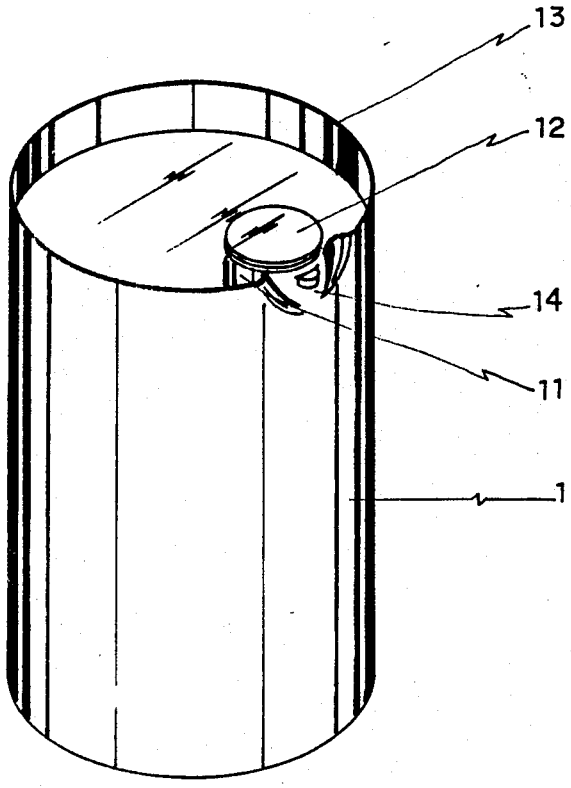
FIG. 1 is a perspective view illustrating the outer appearance of the present invention.

Referring to FIG. 1, there is shown a container or bottle 1, a bottle neck 11, and a bottle cap 12. The bottle 1 has a body having a cylindrical contour, and a pair of opposing end members similar to that of a can typically used as a beverage container. However, bottle 1 includes a protective ring portion 13 integrally formed in one-piece formation at the top portion of bottle 1, extending above the upper end of the bottle a height equal to the height of the bottle closure formed by the bottle neck 11 and bottle cap 12.

The protective ring portion 13 is formed with an inward slanting concave portion 14 positioned adjacent the bottle neck 11. The inward slanting concave portion 14 allows easy access to the bottle cap 12 while permitting ring portion 12 to provide suitable protection of the closure during handling and delivery of the container.

Figure 2:
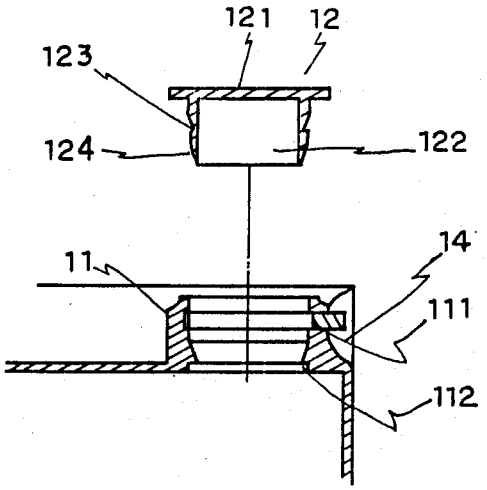
FIG. 2 is a partial sectional view of the present invention.

Referring to FIG. 2, the bottle closure is comprised of the bottle neck 11 and the bottle cap 12. The bottle cap 12 is formed by a head 121 integrally formed in one-piece formation to a body 122. The head 121 may be formed in any of a variety of visually attractive shapes, for adding marketing appeal to the container. The body 122 of cap 12 defines an interior hollow body having an outer surface in which is formed an engagement step 123. The engagement step 123 is formed by an annular notch formed in the outer surface. The distal end of body 122 has a conical contour 124 to provide "lead-in" for cap 12.

The diameter of the interior bore of the bottle neck 11 and the diameter of the exterior bore of the body 122 of the bottle cap 12 are of predetermined dimension to provide a tight fit therebetween. A flexible annular spring 111 is disposed within an annular groove formed in the interior cylindrical wall of the bottle neck 11 and positioned releasable coupling with engagement step 123. Additionally, the distal conical contour 124 formed on the external surface of the body 122 will contiguously interface with an internal truncated conical ring portion 112 of the bottle neck 11. The aforementioned structure provides an excellent air-tight seal for the container 1. To prevent the top portion of container 1 from collecting dirt and debris, a thin film covering (not shown) can be added, as is well known in the packaging art. This film covering can subsequently be removed when the container is to be opened.

Figure 3:
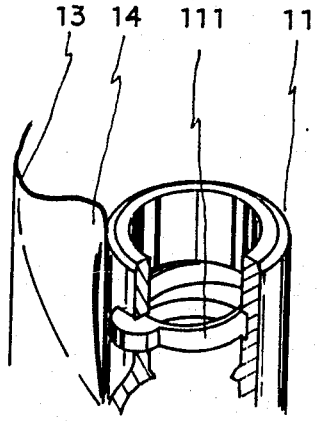
FIG. 3 are partial sectional views illustrating the operation of the present invention.
Figure 3:
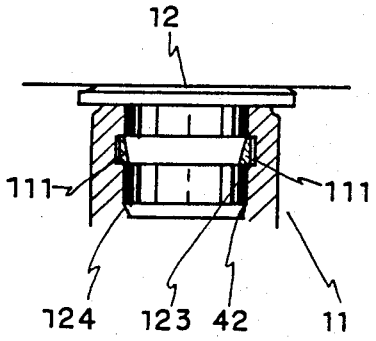
Figure 3:
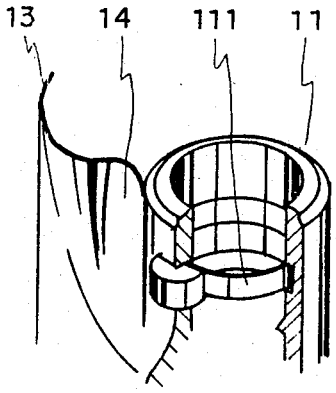

Referring now to FIG. 3, the closure is opened by slightly pressing the annular spring 111 by means of an operating projection extending from the spring through an opening formed in the bottle neck 11. The through opening extends from the annular groove to the outside surface of bottle neck 11.

Pressure applied to the spring results in deformation and displacement thereof, the spring being cause to expand into the annular groove formed in the bottle neck 11 and thereby separating from the engagement step 123 of bottle cap body 122. Thus, the bottle cap 12 can be easily removed from the bottle neck 11.

When the bottle cap has to be tightly closed again, the body 122 of the bottle cap 12 is placed into the bottle neck 11 and pressed down firmly. This action causes the annular spring 111 to re-engage the engagement step 123 for firmly holding the cap 12 in position. Thereby providing a very simple operation.

Additionally, as the body 122 of the bottle cap 12 is hollow inside, it will produce a pleasing sound effect when the bottle is being opened. If the liquid contained in the bottle 1 is carbonated or the like, the difference in pressure which exists between the exterior and the interior of the bottle will cause the bottle cap 12 to be displaced from the bottle neck 11, accompanied by a loud, but pleasant sound effect, producing a pleasing atmospheric effect, similar to that experienced when opening a bottle of champagne.

Further, the design of the inward slanting concave portion 14 of protection ring 13 permits the opening of the bottle to be accomplished with a single hand. The location of the bottle neck 11 being displaced from the perimeter edge of the container 1 protects the operating projection of annular spring 111 from being triggered during delivery or handling and thereby inadvertently opening the container.

The bottle 1 and the bottle neck 11 are integrally formed in one-piece formation of plastic material composition by means of well known molding processes. The resulting container structure is easy to operate, inexpensive to manufacture, and more practical and durable to use.

What is claimed is:

1. A container and closure system, comprising:

a. a housing formed by a body member having a cylindrical contour and a pair of respective top and bottom end members for defining an enclosed space therein;

b. a bottle neck member having a cylindrical wall coupled to said top end member for providing fluid communication with said interior space of said housing to define an access opening for said housing, said neck member having an annular recess formed in an interior surface of said cylindrical wall, and a through opening formed in said cylindrical wall in juxtaposition with said annular recess;

c. means for sealing said access opening releasably coupled to said bottle neck member, said sealing means includes a tubular engagement member extending longitudinally from a head member defining a hollow cavity closed on one end by said head member, said tubular engagement member having an annular notch formed in an external surface thereof;

d. spring means disposed in said annular recess for releasably lockingly engaging said sealing means within said bottle neck member, said spring means includes an annular spring member disposed within said annular recess of said bottle neck member, and an operating member extending from said annular spring member through said bottle neck member through opening for coupling a force applied to said operating member to said annular spring member; and, e. a protective ring member extending a predetermined distance from said top end member for protecting said bottle neck member, said protective ring member having a height dimension substantially equal to a combined height of said bottle neck member and said sealing means head member.

2. The container and closure system as recited in claim 1 where said bottle neck member is located a predetermined distance from a perimeter portion of said top member.

3. The container and closure system as recited in claim 2 where said protective ring member includes an inwardly slanting concave portion located in juxtaposition with said bottle neck member.

4. The container and closure system as recited in claim 1 where said bottle neck member includes an internal ring portion having a truncated conical contour defining a sealing surface.

5. The container and closure system as recited in claim 4 where said sealing means tubular engagement member includes a distal end portion having an external surface with a conical contour for contiguous interface with said internal ring portion of said bottle neck member.

* * * * *